US006951270B2

(12) United States Patent
Liu

(10) Patent No.: US 6,951,270 B2
(45) Date of Patent: Oct. 4, 2005

(54) SILENT RATCHET ACTUATOR

(75) Inventor: Jintao Liu, Windsor (CA)

(73) Assignee: L & P Property Management Company, South Gate, CA (US)

( * ) Notice: Subject to any disclaimer, the term of this patent is extended or adjusted under 35 U.S.C. 154(b) by 2 days.

(21) Appl. No.: 10/760,942

(22) Filed: Jan. 20, 2004

(65) Prior Publication Data

US 2005/0155836 A1 Jul. 21, 2005

(51) Int. Cl.[7] ..... B60N 2/16; F16D 59/00
(52) U.S. Cl. ..... 192/223.2; 192/19
(58) Field of Search ..... 192/223.2, 19, 192/12 B, 27, 38, 44; 188/82.2, 82.4, 82.84; 74/142, 143

(56) References Cited

U.S. PATENT DOCUMENTS

| | | | | |
|---|---|---|---|---|
| 5,794,479 | A * | 8/1998 | Schwarzbich | 74/143 |
| 6,273,233 | B1 * | 8/2001 | Denis | 192/223.2 |
| 6,481,557 | B2 * | 11/2002 | Denis | 192/223.2 |
| 6,641,215 | B2 * | 11/2003 | Rohee | 192/223.2 |
| 6,688,443 | B2 | 2/2004 | Liu | |
| 2003/0061899 | A1 | 4/2003 | Liu et al. | |
| 2003/0173182 | A1 * | 9/2003 | Kim | 192/223.2 |
| 2003/0196868 | A1 | 10/2003 | Liu et al. | |

* cited by examiner

*Primary Examiner*—Rodney H. Bonck
(74) *Attorney, Agent, or Firm*—Husch & Eppenberger, LLC; Grant D. Kang; Robert C. Haldiman

(57) ABSTRACT

An actuator for a traction device comprising has a locking clutch adapted for operative communication with a traction device. It has a drive disc having drive tabs. The drive tabs project axially into driving engagement with the locking clutch. The drive disc has a seat with an inner face. A drive shaft with a cam having an outer face is disposed within the seat of the drive disc such that said outer face of the cam and the inner face of the seat define a first constricting channel and a second constricting channel. The cam further has a projection. Locking rollers are disposed within the constricting channels. A fixed stop is disposed between the cam outer face and the inner face of said seat and between the first locking roller and the second locking roller. Springs are disposed in the constricting channels between the locking rollers and the projection. Thereby, a rotational force applied on the drive shaft in a first rotational direction compresses a first spring and a rotational force applied to the drive shaft in a second rotational direction compresses a second spring. After release of the first rotational force in the first direction, the first spring biases the cam towards a home position and after a release of the second rotational force in the second direction, the second spring biases the cam towards a home position.

12 Claims, 5 Drawing Sheets

SILENT RATCHET ACTUATOR

CROSS-REFERENCE TO RELATED APPLICATIONS

None.

STATEMENT REGARDING FEDERALLY SPONSORED RESEARCH OR DEVELOPMENT

Not Applicable.

APPENDIX

Not Applicable.

FIELD OF THE INVENTION

This invention is in the field of actuators for moving components of seats and furniture, especially ergonomic supports such as lumbar supports, and most particularly when installed in automobile seats.

BACKGROUND OF THE INVENTION

Most automobiles today, and some furniture for office and home, include some movable ergonomic supports such as lumbar supports. Whether these supports move by bending or sliding, it is common for the movement to be produced by traction. A commonly used device for applying traction to movable ergonomic support parts is a traction cable, such as Bowden cable. Such cables have a sleeve or conduit having a wire inside the sleeve and disposed to slide axially through it. These cables are installed so that one sleeve end is connected to one portion of an ergonomic support and the wire end is connected to another portion. At the other end of traction cable, pulling the other wire end relative to the other sleeve end will have the effect of moving the wire end relative to the sleeve end at the ergonomic support. This movement effects the movement of the support parts.

A wide variety of actuators are used for applying the traction to the traction cable. Some are powered by electric motors. Others are manual. All of them must achieve the functional requirements that the traction cable sleeve end and the traction cable wire end be moved relative to one another, and that the actuator hold a selected position of the traction cable wire relative to the traction cable sleeve, against a return or home biased force exerted on the traction cable by the weight of the passenger on the ergonomic support. In addition to these minimal requirements, a variety of other features are valued in the market place and desirable in the actuator design. One of these is that the movement of the actuator be silent. Other continuing needs and preferences are for durability, ease of assembly, economy, a responsive and precise "feel" to the hand of the user, and a thin and compact package in order to conserve space.

SUMMARY OF THE INVENTION

The present invention is a silent actuator combining a lower locking clutch with an upper drive assembly including a cam, at least one locking roller and at least one homing spring.

An actuator for a traction device comprising has a locking clutch adapted for operative communication with a traction device. It has a drive disc having drive tabs. The drive tabs project axially into driving engagement with the locking clutch. The drive disc has a seat with an inner face. A drive shaft with a cam having an outer face is disposed within the seat of the drive disc such that said outer face of the cam and the inner face of the seat define a first constricting channel and a second constricting channel. The cam further has a projection. Locking rollers are disposed within the constricting channels. A fixed stop is disposed between the cam outer face and the inner face of said seat and between the first locking roller and the second locking roller. Springs are disposed in the constricting channels between the locking rollers and the projection. Thereby, a rotational force applied on the drive shaft in a first rotational direction compresses a first spring and a rotational force applied to the drive shaft in a second rotational direction compresses a second spring. After release of the first rotational force in the first direction, the first spring biases the cam towards a home position and after a release of the second rotational force in the second direction, the second spring biases the cam towards a home position.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DETAILED DESCRIPTION OF THE PREFERRED EMBODIMENTS

Figure 1:
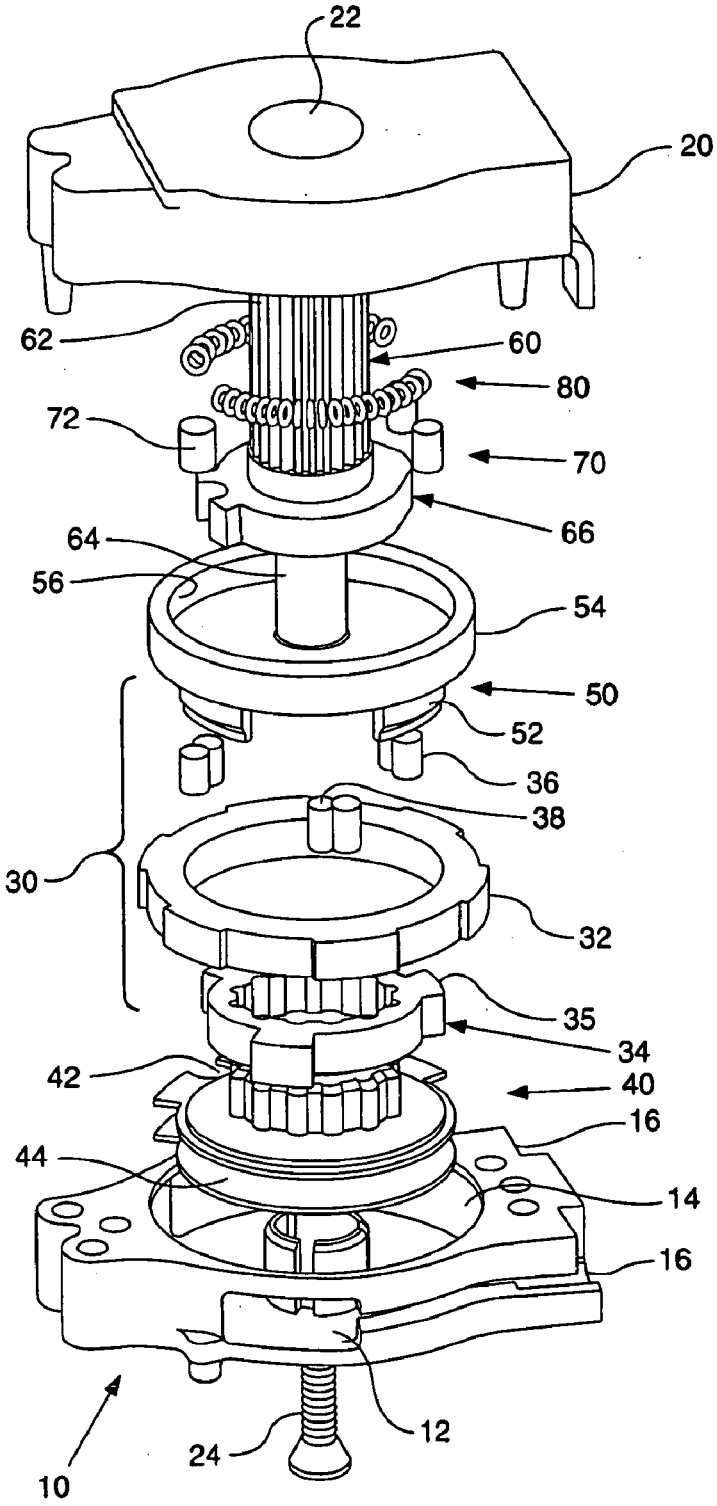
FIG. 1 is an exploded view from an upper perspective.

Referring to the accompanying drawings in which like reference numbers indicate like elements, FIG. 1 is an exploded view of the actuator of the present invention from an upper perspective. The actuator includes a housing bottom 10 and a housing top 20. The housing bottom 10 includes a seat 14 for installation of the moving components of the actuator described below. The housing bottom 10 also includes a slot 12, preferably key hole shaped, for assembly of the actuator with a traction cable and insertion of a traction cable wire (not shown) into the actuator assembly. The housing bottom 10 finally includes a seat 16 for a traction cable sleeve end. (Other traction devices, such as rods, may be actuated well.)

A Bowden traction cable is assembled with the lower pulley 40. Pulley 40 has a channel seat 44 for a Bowden cable wire and a Bowden cable wire end bullet mount 42. The wire is drawn from the traction cable and slid into slot 12. The wire has a bullet or other wide ending for this mounting. This is slid through the wide key hole portion of slot 12 and installed in the mounting slot 42 of pulley 40. The wire is seated in channel 44. The traction cable sleeve is seated in the sleeve end seat 16. When the pulley is turned, in the counterclockwise direction in the depicted embodiment, the traction cable wire will be drawn from the traction cable sleeve.

Part of the silent actuator of the present invention is a locking clutch or brake assembly 30. The components of the locking clutch include a ring 32, a hub 34, clutch locking rollers 36 and clutch springs 38. In the depicted embodiment clutch springs 38 are rubber grommets that are cylindrical in shape. The operation of such a locking clutch or brake is disclosed in detail by application Ser. Nos. 10/005,725, 10/425,413, and 10/005,662, the disclosures of which are fully incorporated by reference herein. Accordingly, only the fundamental operation of the locking clutch assembly 30 is described presently. The hub 34 includes an eccentric or cam shaped surface. In the depicted embodiment there are three such surfaces, separated by tabs or bosses 35. Hub 34 and ring 32 are assembled on the same plane. Between them are defined three constricting channels. Within these channels are disposed clutch rollers 36 and rubber clutch grommets 38. The grommets are installed immediately next to the tabs 35. The locking rollers 36 are installed next to the rubber grommets on this side of the grommet opposite the tab. In the remaining space of the constricting channel a drive tab 52 is inserted from above. Housing bottom 10 seats pulley 40.

In operation, drive tabs 52 are turned, counterclockwise from above in the depicted embodiment, to push tabs 35 to move the assembly towards the position to be selected by a user, and against the tension of the traction cable attached to the ergonomic support. Rubber grommet 38 and locking roller 36, then being in the wide portion of the constricted channel, simply follow.

Turning hub 34 also turns pulley 40 which is coaxially and co-rotating assembled with hub 34. Accordingly, turning pulley 40 applies traction to a traction cable wire, pulling it out of the end of a traction cable sleeve (not shown) which is mounted in sleeve mount 16.

After a selected position has been reached, a user releases pressure applied to the drive shaft 60. Thereafter a return pressure is exerted on the hub by the tension put on the Bowden cable wire by the user's weight on the support. However, this reverse homing tension causes the locking rollers 36 to advance into the narrow part of the constricting channel where they lock and hold the selected position.

A return to an original or home position of the ergonomic support is achieved by releasing the locking clutch assembly 30 by rotating tabs 52 against clutch locking rollers 36 in order to push them into the wide part of the constricting channel between hub 34 and ring 32.

The upper silent drive assembly is comprised of drive force transfer disc 50, drive shaft 60, locking rollers 70 and springs 80. Drive shaft 60 includes a finned portion 62 which proceeds through hole 22 in upper housing 20. This upwards extension becomes a mount for a lever or wheel (not shown) which a seat occupant will use to apply force to the assembly for adjusting his or her lumbar support. The drive shaft 60 also includes a lower extension 64 which proceeds through a hole in disc 50 downwards through pulley 40 and a coaxial hole in lower housing unit 10. A recess, preferably threaded, in lower extension 64 will receive a screw, bolt, rivet or other fixation device 24 for holding the entire assembly together.

Figure 2:
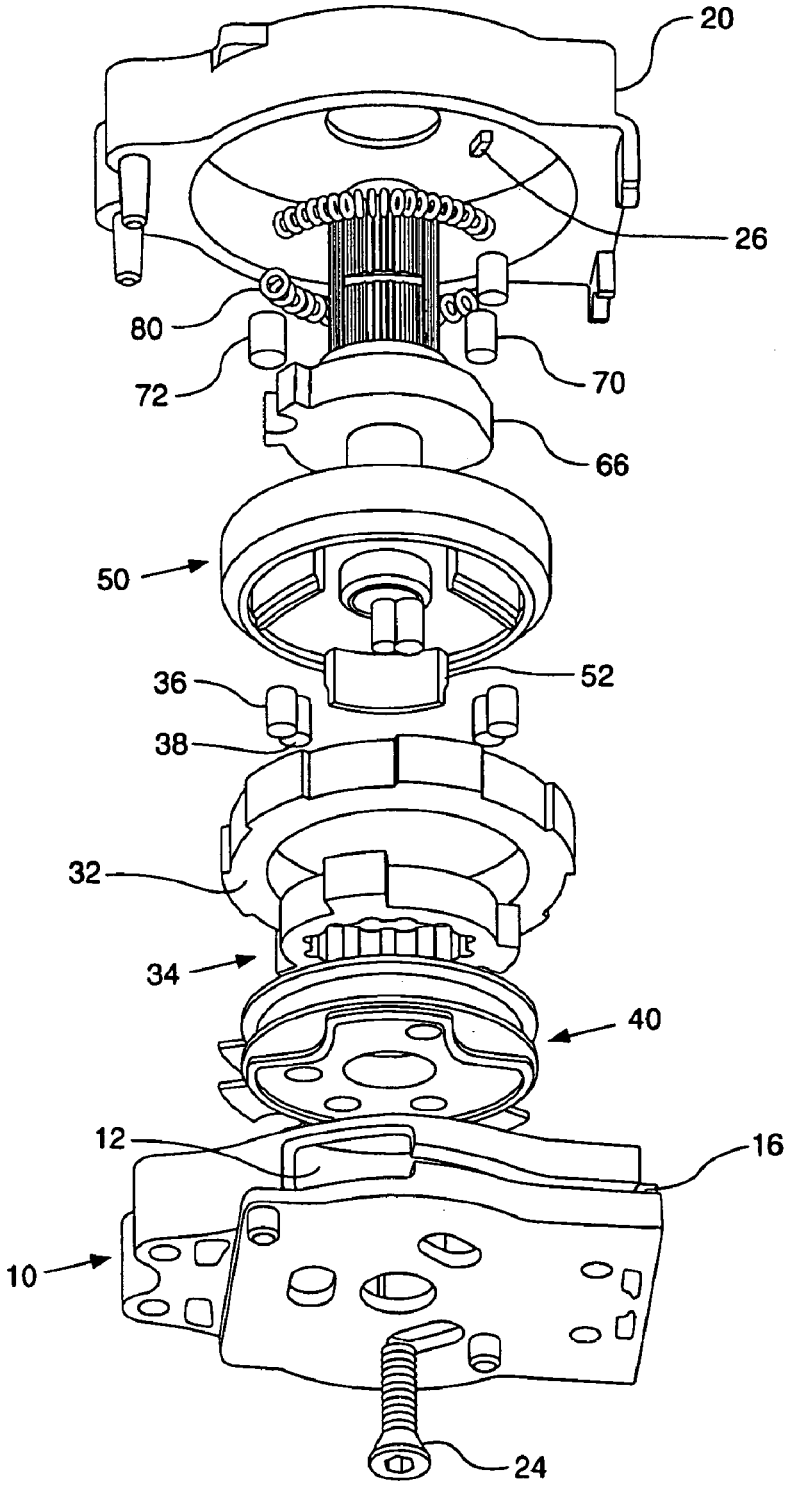
FIG. 2 is an exploded view from a lower perspective.
Figure 3:
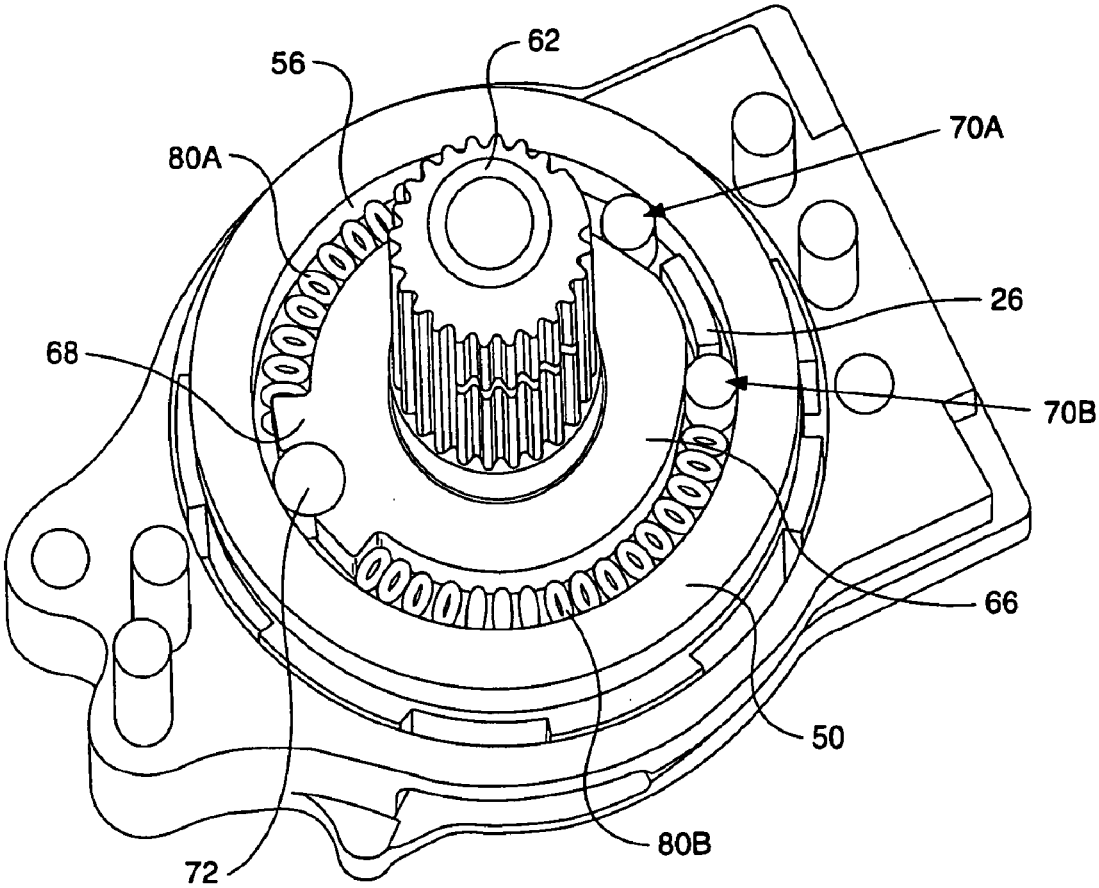
FIG. 3 is a perspective view of a partially disassembled actuator.
Figure 4:
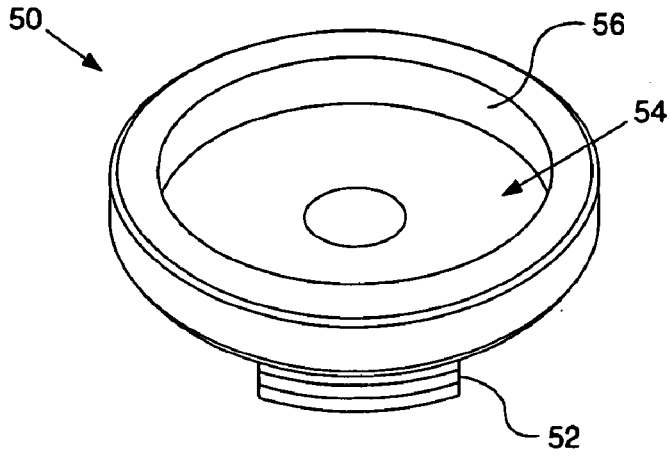
FIG. 4 is a top view of a driveshaft.
Figure 5:
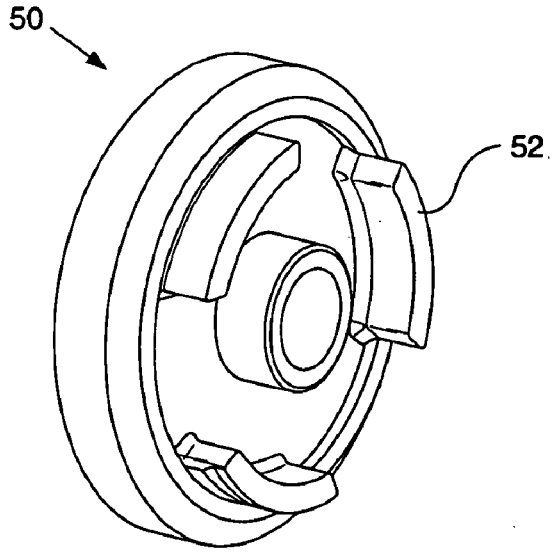
FIG. 5 is a side view of a driveshaft.
Figure 6:
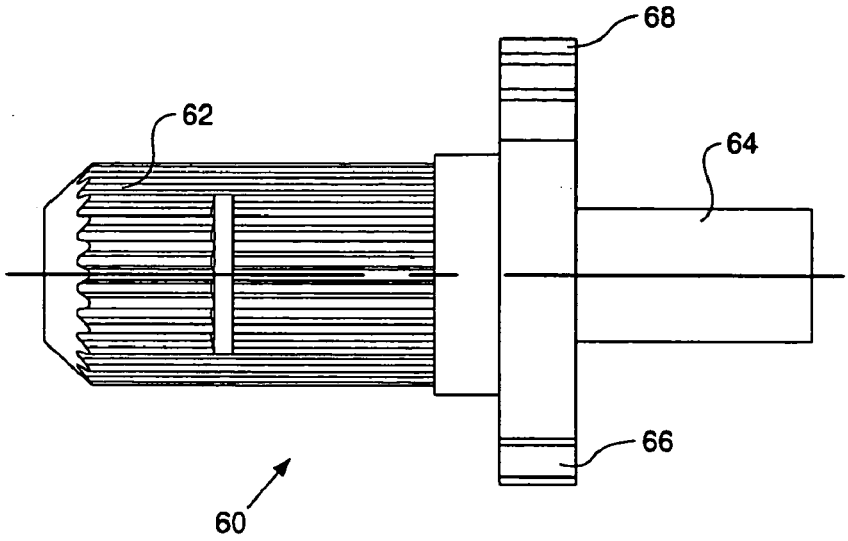
FIG. 6 is an isometric view of a drive disc.
Figure 7:
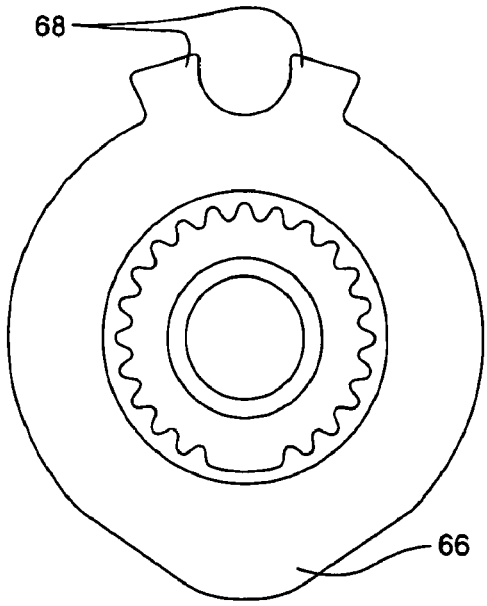
FIG. 7 is another isometric view of the drive disc.

Between its upper extension 62 and lower extension 64, drive shaft 60 has a cam 66. This cam is on the same plane as ring 50. Ring 50 includes a seat 54 for receiving, again on the same plane, locking rollers 70, cam 66, springs 80 and a stop, 26, best seen on FIG. 2. The stop is fixedly attached to or integrally formed with, as by molding, upper housing 20. Any components may be metal or plastic. In the depicted embodiment, drive disc 50 and locking rollers 70 are metal, and other components are plastic.

Cam 66 is thickest at a position in line with stop 26 and between locking rollers 70A and 70B. That is, the outer surface of cam 66, together with the inner wall 56 of seat 54, form constricting channels in which locking rollers 70 operate. In the depicted embodiment, two bilateral constricting channels are shown, although fabrication or assembly that yields only one, or more than two, constricting channels, is within the scope of the present invention. The channel constricts to a narrow portion substantially corresponding to and in registry with tab 26. From the narrow portion, the constricting channel widens, bilaterally in the depicted embodiment, as it progresses towards the position in which the rollers 70 are disposed and onwards to that portion of the channel in which springs 80 are disposed. Alternative embodiments also considered to be within the scope of the present invention would include an eccentrically shaped inner surface of vertical face 56 of seat 54 combined with a circular outer surface of the disc 66. Any such configuration forming constricting channels when assembled are within the scope of the present invention.

Substantially opposite of the stop 26 is a passive roller 72. The passive roller acts to stabilize the assembly and smooth its operation. The passive roller 72 is held in place with projections 68. This pair of projections 68 serve two purposes. First, between them the passive roller 72 is seated. Second, on their outer faces they provide a face against which homing springs 80 may act and be acted upon. All three rollers may be cylindrical or spherical. Locking rollers may be other shapes, such as wedges, provided they comprise an element that locks motion of cam 66 and disc 50.

In operation, a user turns a lever or wheel (not shown) in order to turn drive shaft 60. Since drive shaft is 60 is not directly or fixedly attached to disc 50 or hub 34, the transfer of the user applied driving force is only applied through the assembly of the cam 66, locking rollers 70 and drive disc 50. If the user applies a force in a counterclockwise direction (when viewed from above) the cam 66 will first rotate until its wide portion comes into contact with locking roller 70A. Locking roller 70A will then be constricted between cam 66 and vertical face 56 of ring 50, and lock. Thereafter, cam 66, locking roller 70A and ring 50 will turn in unison. As ring 50 turns, integrally formed vertical tabs 52 on ring 50 will also turn. Turning tabs 52 has the effect of also turning the lower locking clutch, hub 34 and pulley 40, in the manner previously described. Consequently, the traction cable wire is drawn from the traction sleeve and the tractive force is transferred to the ergonomic device, actuating it.

At the drive assembly, while the locking roller 70A is turning the ring 50, the opposite locking roller, 70B, is restrained from turning in a counterclockwise direction with the rest of the assembly by stop 26. Stop 26 is fixed in place. In the depicted embodiment, it is a part of upper housing 20, which is fixed. As projection 68 rotates and stop 26 and locking roller 70B do not, spring 80B is compressed between locking roller 70B and projection 68. While the user turns the lever, there is sufficient force to compress spring 80B through a substantial range, approaching 180°. The actuator will usually need to be turned several times in order to put the ergonomic device that it actuates through a full range of motion. Alternatively, the user may stop turning the device at any time when a selected comfortable position is reached. When the user stops turning, either because he has reached his selected position, or because the drive shaft is turned as far it can go, the user will release the lever. At this time, the compressed spring 80B will exert its expansive force between locking roller 80B and projection 68. Because locking roller 70B is held in place by fixed tab 26, the expanding force of spring 80B will act on projection 68 in order to turn cam 66 and drive shaft 60 in a clockwise direction back to its home position. The ring 50 will be held in its position by the previously described action of the locking clutch assembly 30.

A return to an original or home position of the ergonomic support is achieved by releasing the locking clutch assembly 30 by rotating tabs 52 against clutch locking rollers 36 in order to push them into the wide part of the constricting channel between hub 34 and ring 32. Consequently, the upper drive assembly must turn ring 50 in a return direction, which in the depicted configuration is clockwise, viewed from above. In order to do so, the user simply turns the lever in the opposite direction, clockwise. The depicted embodiment is bilaterally symmetrical. Therefore, the operation is the same, but reversed. Clockwise rotation of cam 66 engages locking roller 70B and through it also engages the vertical face 56 of drive disc 50, turning it clockwise. As rotation progresses, stop 26 will hold locking roller 70A in place and spring 80A will be compressed between projection 68 and locking roller 70A. When a new position of the ergonomic support is selected by the user, or when the assembly progresses as far as it is able to, the user will release the handle and spring 80A will expand between locking roller 70A and projection 68 in order to turn drive shaft 62 back to a home position. This movement is not restricted by locking roller 70B, because rotation of the cam in that direction will bias the locking roller 70B towards the wider part of the channel between the cam 66 and vertical face 56, allowing it to move.

One of the several advantages of the present invention is that the drive apparatus is silent. Another advantage is that the overall package is compact and flat, in that the drive assembly is seated within an already necessary component of the locking clutch assembly, that is, drive disc 50. This creates a thinner overall axial dimension. Moreover, homing springs 80A and 80B are actually within the radius of drive disc 50. This keeps the circumferential diameter of the entire assembly smaller, further compacting the size of the actuator.

In view of the foregoing, it will be seen that the several advantages of the invention are achieved and attained.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. An actuator for a traction device comprising:

a locking clutch adapted for operative communication with a traction device;

a drive disc having at least one drive tab, said drive tab projecting axially into driving engagement with said locking clutch, and said drive disc having a seat with an inner face;

a drive shaft having a cam, said cam having an outer face and said cam being disposed within said seat of said drive disc such that said outer face of said cam and said inner face of said seat define at least one constricting channel, said cam further having a projection;

a fixed stop;

a locking element disposed within said constricting channel adjacent said fixed stop; and a spring disposed between said projection of said cam and said locking element such that rotational force on said cam in a first direction rotates said locking clutch and applies traction to said traction device, and such that after said rotational force is released, said spring biases said cam back towards a starting position.

2. The actuator of claim 1 wherein said cam and said drive disc are coaxial.

3. The actuator of claim 1 further comprising a housing.

4. The actuator of claim 1 wherein said fixed stop is integrally formed with a housing.

5. The actuator of claim 1 wherein said locking element is configured in a shape selected from the group consisting of: a sphere, a cylinder and a wedge.

6. The actuator of claim 1 further comprising a passive roller, said passive roller being disposed between said cam and said inner face of said seat of said drive disc.

7. The actuator of claim 1 further comprising a second spring and a second locking element, disposed in a second constricting channel.

8. The actuator of claim 1 wherein said spring is within said constricting channel.

9. The actuator of claim 1 wherein said spring is disposed to bias said locking element towards a narrow end of said constricting channel.

10. The actuator of claim 1 wherein said spring is on the same plane as said cam and said disc.

11. The actuator of claim 1 wherein said traction device is a Bowden cable.

12. An actuator for a traction device comprising:

a locking clutch adapted for operative communication with a traction device;

a drive disc having drive tabs, said drive tabs projecting axially into driving engagement with said locking clutch, and said drive disc having a seat with an inner face;

a drive shaft having a cam, said cam having an outer face and said cam being disposed within said seat of said drive disc such that said outer face of said cam and said inner face of said seat define a first constricting channel and a second constricting channel, said cam further having a projection;

a first locking roller disposed within said first constricting channel and a second locking roller disposed within said second constricting channel;

a fixed stop disposed between said cam outer face and said inner face of said seat and disposed between said first locking roller and said second locking roller;

a first spring and a second spring, said first spring being disposed in said first constricting channel between said first locking roller and said projection and said second spring being disposed in said second constricting channel between said second locking roller and said projection;

whereby, a rotational force applied on said drive shaft in a first rotational direction compresses said first spring and a rotational force applied to said drive shaft in a second rotational direction compresses said second spring and whereby after release of the first rotational force in said first direction, said first spring biases said cam towards a home position and after a release of the second rotational force in said second direction, said second spring biases said cam towards a home position.

* * * * *